US010429058B2

(12) United States Patent
McKean et al.

(10) Patent No.: US 10,429,058 B2
(45) Date of Patent: Oct. 1, 2019

(54) HIGH VISIBILITY TOOL HANDLE WITH ACTIVE ILLUMINATION

(71) Applicants: Matthew L McKean, Reynoldsburg, OH (US); Scott Russell, Plain City, OH (US)

(72) Inventors: Matthew L McKean, Reynoldsburg, OH (US); Scott Russell, Plain City, OH (US)

(73) Assignee: GLOCORE TOOLS, LLC, Reynoldsburg, OH (US)

( * ) Notice: Subject to any disclaimer, the term of this patent is extended or adjusted under 35 U.S.C. 154(b) by 0 days.

(21) Appl. No.: 15/168,993

(22) Filed: May 31, 2016

(65) Prior Publication Data

US 2016/0348892 A1 Dec. 1, 2016

Related U.S. Application Data

(60) Provisional application No. 62/167,510, filed on May 28, 2015.

(51) Int. Cl.

| | |
|---|---|
| ***F21V 33/00*** | (2006.01) |
| ***B26B 23/00*** | (2006.01) |
| ***B25D 1/00*** | (2006.01) |
| ***B25G 1/01*** | (2006.01) |
| ***B25D 7/00*** | (2006.01) |
| ***B25G 1/04*** | (2006.01) |
| ***B25G 3/26*** | (2006.01) |
| ***B25G 3/36*** | (2006.01) |

(52) U.S. Cl.

CPC ..... *F21V 33/0084* (2013.01); *B25D 1/00* (2013.01); *B25D 7/00* (2013.01); *B25G 1/01* (2013.01); *B25G 1/04* (2013.01); *B25G 3/26* (2013.01); *B25G 3/36* (2013.01); *B26B 23/00* (2013.01); *B25D 2250/111* (2013.01)

(58) Field of Classification Search

CPC .. F21V 33/0084; B25D 2250/111; B25D 7/00
See application file for complete search history.

(56) References Cited

U.S. PATENT DOCUMENTS

| | | | | |
|---|---|---|---|---|
| 4,099,535 A * | 7/1978 | Hubachek | A45B 3/04 | 135/66 |
| 4,369,486 A * | 1/1983 | Pool | G02B 6/0005 | 362/120 |
| 4,924,358 A * | 5/1990 | Von Heck | F21K 2/06 | 362/102 |
| 5,226,718 A * | 7/1993 | Lin | A45B 3/04 | 362/102 |

(Continued)

OTHER PUBLICATIONS

Wayback Machine internet archived web page from January of 2013 from blinkee.com:https://web.archive.org/web/20130128123401/http://blinkee.com/product.php?id=LED%20Light%20Up%20Spoon%20Blue (Year: 2013).*

*Primary Examiner* — Evan P Dzierzynski
(74) *Attorney, Agent, or Firm* — Standley Law Group LLP; Stephen Grant

(57) ABSTRACT

The present invention is a durable illuminated shaft affixed to a tool portion. The shaft being configured to provide a level of illumination that may be seen by others in an area adjacent to the shaft order to increase the visibility of a worker to prevent accidents and injury.

13 Claims, 8 Drawing Sheets

(56) References Cited

U.S. PATENT DOCUMENTS

| | | | | |
|---|---|---|---|---|
| 6,188,228 | B1 * | 2/2001 | Philipp | B25D 1/00 324/642 |
| 8,550,516 | B2 * | 10/2013 | Best | A01B 1/02 294/49 |
| 2004/0156189 | A1 * | 8/2004 | Opolka | B25D 1/00 362/119 |
| 2007/0014108 | A1 * | 1/2007 | Uke | B25F 1/00 362/191 |
| 2007/0019398 | A1 * | 1/2007 | Chen | B60Q 7/00 362/102 |
| 2008/0016698 | A1 * | 1/2008 | Simpson | A47G 21/02 30/142 |
| 2010/0024605 | A1 * | 2/2010 | Hiltz | B25D 1/00 81/20 |
| 2013/0141899 | A1 * | 6/2013 | Lee | A45B 3/04 362/102 |

* cited by examiner

HIGH VISIBILITY TOOL HANDLE WITH ACTIVE ILLUMINATION

CROSS-REFERENCE TO RELATED APPLICATION

This application claims priority to provisional application 62/167,510 filed on May 28, 2015 and is incorporated by reference in its entirety as if fully recited herein.

TECHNICAL FIELD

The invention disclosed herein relates to a tool having an elongate shaft, a first end of which is equipped with a handle and the second end of which has a work head mounted thereon. A light source in the first end provides light that emanates in a diffused radially outward manner along the length of the shaft, enhancing the visibility of the work tool, a user thereof, and the surrounding area, under low light conditions.

BACKGROUND

In many work conditions, a worker's visibility to others is crucial to the safety of that person or others. Examples of such situations may include police and fire personnel or construction workers working at night or in low visibility conditions. In such situations, the ability for others to quickly and easily identify the location of such persons may mean the difference between safety and injury. A known method of providing such visibility is the application of reflective materials to clothing and vehicles. A common example is the orange safety vest worn by construction workers. A shortcoming of reflective materials is that they are passive, that is, they rely on light shining on the reflective material in order to provide an indication of the presence of the wearer. One solution to this problem is to equip these workers with flashlights or flares that may be used to indicate that a worker is present. However, this approach is often undesirable because of the necessity of holding the flashlight or flare while performing a task. In many cases, the person in need of additional visibility is performing a task that requires a tool such as a shovel, fire ax or pike. What is needed is a device that provides additional visibility to enhance the safety of a worker without requiring that the worker hold a separate device when performing a task that exposes the worker to injury if they lack such visibility.

In certain circumstances, a person may be required to work in an environment that provides little in the way of ambient light. An example of such a circumstance is a construction worker working at night or in other conditions that do not provide adequate lighting. Other examples may be mining, firefighting or search and rescue operations. Frequently workers in such conditions are required to use tools to perform their work. Examples may include, shovels, axes, pikes, and hammers. When working in these conditions, a worker may drop or misplace a tool and as a result, have to spend time locating the misplaced tool. In the example of firefighting, lost time trying to locate a tool may endanger the firefighter or those that the fire fighter is tasked with rescuing. What is needed is a device that increases the visibility of a tool used in a low-light condition to assist the user in locating a misplaced or dropped tool.

It is therefore an unmet requirement of the prior art to provide a work tool in which a shaft of the work tool provides lighting that is diffused radially along the shaft, enhancing the visibility of the work tool in low light conditions.

SUMMARY

In an embodiment of the present invention, a tool handle may be formed from a light transmissive material and provided with a light source that illuminates such a tool handle from within. This illumination may result in increased visibility and safety of the user. Such an embodiment may also improve the user's ability to locate the tool should it be dropped or otherwise misplaced.

Since the light emanates from an elongate shaft, it simulates other types of elongate light sources, such as a fluorescent tube, that provide diffuse radially-directed light rather than axial light, as would be provided by a flashlight. The shaft of the present invention is much more durable than a fluorescent tube, which would not be practical or safe in a work environment. The radial direction of the light emitted by the shaft provides a wide area of diffuse coverage, allowing the user to readily observe peripheral objects that may miss detection by an axial light source.

Further features and advantages of the devices and systems disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components references are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Figure 1:
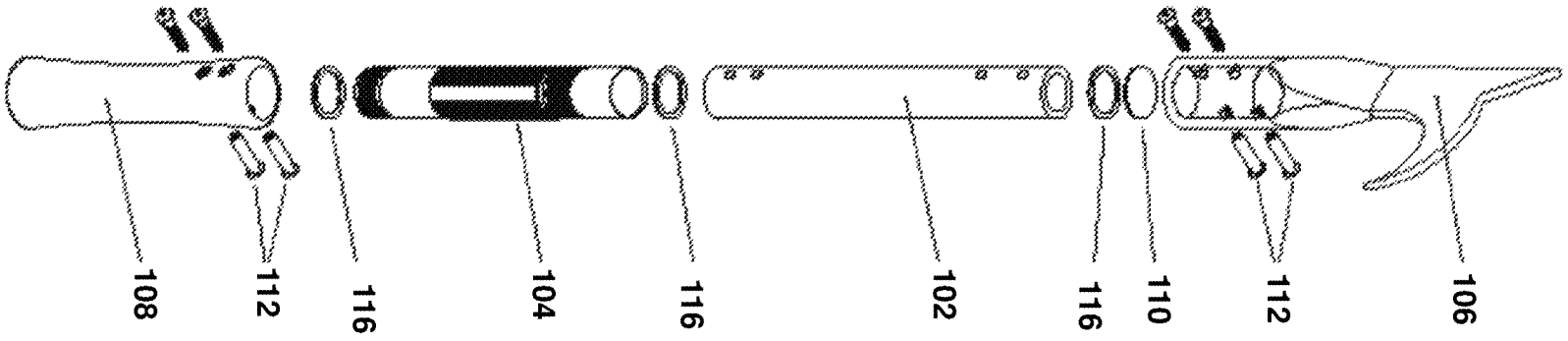
FIG. 1 is an exploded view of an embodiment of the invention.
Figure 2:
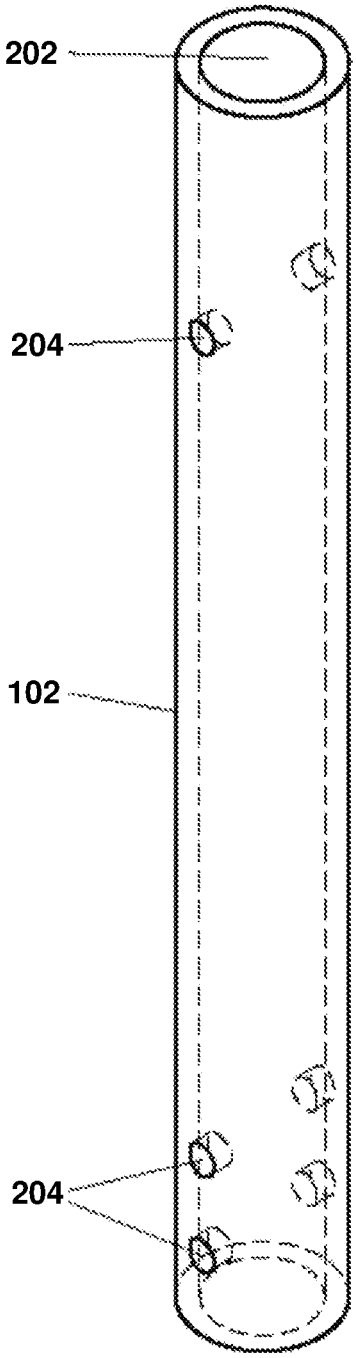
FIG. 2 is a perspective view of a shaft portion of the invention.

A method and apparatus for providing a tool handle that emits light along its length is disclosed herein. Such light being emitted primarily in a radial manner to increase the visibility of the user of the tool, provide ambient light in an area surrounding the tool, and also to make the tool more visible in low light conditions. As one ordinarily skilled in the art will realize, such a tool handle must be formed from a durable material. It is further desirable that the tool handle does not add unnecessary weight to the tool to which it is affixed. As is illustrated in FIG. 1, an embodiment of the invention may be formed using a shaft 102, a light source 104, and a tool device 106 to be affixed to an end of the shaft 102 and in certain embodiments, a hand grip portion 108. In an embodiment of the invention, a tool handle shaft 102 may be required to tolerate a force applied by the user in the process of using the tool. For example, in an embodiment where the tool to which the handle is affixed is an ax, the shaft 102 must be able to survive repeated striking applications of the ax head to a surface to be chopped by the ax. In such embodiments the shaft must not be so flexible that force applied by the user is not effectively transferred to the ax head. A similar application may be the use of the invention in the handle of a hammer. Other applications may be somewhat flexible but must be rigid enough as to prevent the shaft from being damaged. For example, in an application in which the tool is a shovel, the user of the shovel may be required to lever the shovel in order to loosen the material which the user is digging. To achieve the desired durability, embodiments of the invention may be formed using thermoplastic polymers such as polycarbonate or polymethylmethacrylate. As one skilled in the art will understand, these compounds are examples of suitable materials. In addition to these, other durable light transmissive materials may also be used. In selecting such a material, it may be important to consider the refractive index of the material. Polycarbonate, which is effectively utilized in the lenses of safety glasses, is particularly attractive for this purpose. Depending upon the required characteristics of the intended application, an embodiment of the shaft 102 may be solid, hollow (tubular) or other configurations as long as the configuration allows light transmission axially along the length of the shaft. As is illustrated in FIG. 2, to provide a more evenly distributed transmission of light, the shaft 102 may be formed such that the radial center of the shaft is hollow 202.

In order to improve the transmission of light radially away from the shaft, an exterior surface (or interior surface if the shaft is tubular in cross-section) may be treated to cause a slightly irregular or rough surface. Such a surface serves to cause light rays projected from a light source 104 to diffuse through to the exterior surface of the shaft. Such a dispersal may cause the shaft to glow or otherwise illuminate along its length.

As is illustrated at 104 of FIG. 1, a light source may be provided at an end of the shaft 102. As embodiments of the invention may include configurations with shafts that are other than the straight cylindrical shaft illustrated. Light sources in certain embodiments may be located at both ends, midpoints of the shaft or combinations thereof. A light source 104 may be comprised of, without limitation, incandescent, fluorescent, chemical, or light emitting diode (LED) sources. LED light sources may be particularly desirable as such sources are available in a plurality of colors, are energy efficient, have a long life and may be constructed to be vibration resistant.

Figure 3:
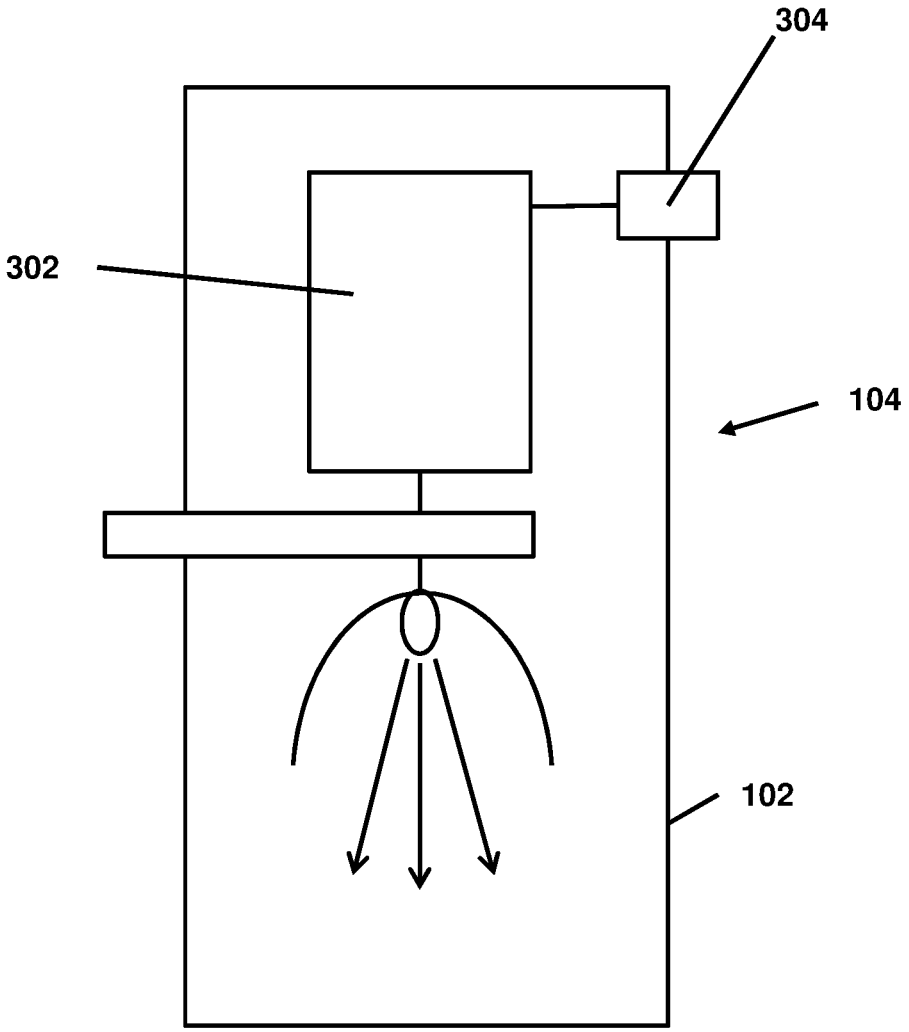
FIG. 3 is a block diagram of an embodiment of a light source used in the invention.

In certain embodiments of the invention, the light source 104 may comprise a reflector that may function to focus a light source such that its output is directed axially along the shaft 102. In the embodiment illustrated, the light source 102 is provided by a flashlight. In such an embodiment, the reflector may be integral to the flashlight. In embodiment in which the light source is powered by electrical current, a battery may be contained in a portion of the light source 104 (such as is the case of a flashlight), the shaft 102, the hand grip portion 108, or the tool 106. Such a battery may be disposable or rechargeable. As is illustrated in FIG. 3, embodiments of the invention which comprise rechargeable batteries 302 may also comprise a charging connector 304 which may be located in a portion of the shaft 102, the hand grip portion 108, or the tool 106, to allow for recharging of the batteries. As is illustrated, such a charging connector 304 may be configured such that a user can access the connector from an exterior surface of the invention so as to avoid having to remove the light source 104 from the shaft 102 for charging the batteries 302.

Figure 4:
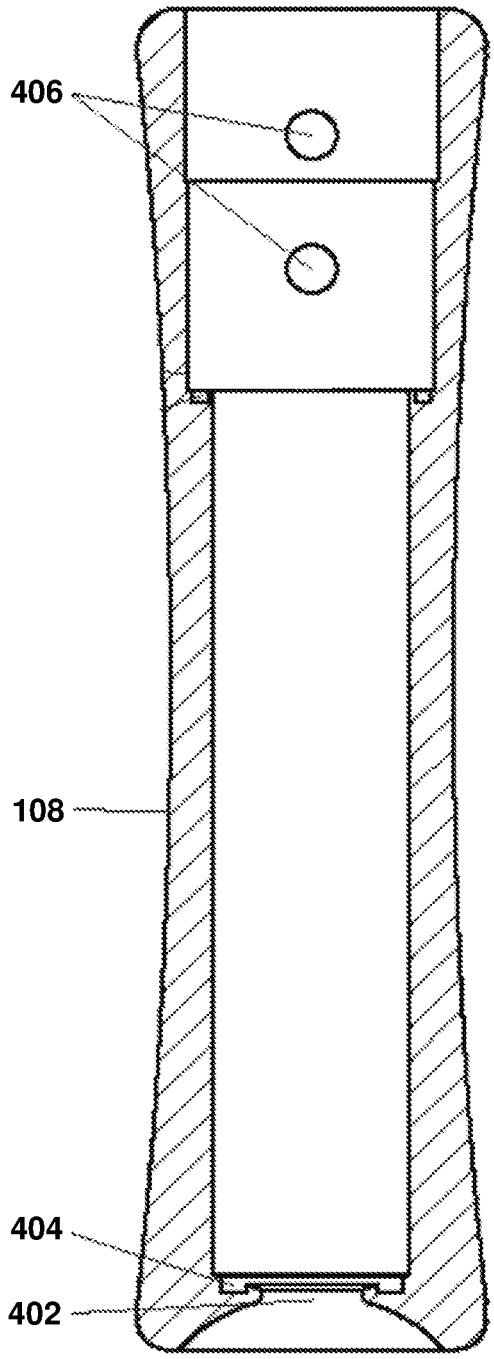
FIG. 4 is cross section view of a handle portion in an embodiment of the invention.

An example embodiment of a light source is illustrated in FIG. 1 at 104. As is illustrated, a hand grip portion 108 may be configured such that the light source is insertable into the hand grip portion to protect it from damage and also allow a user to more easily grip the shaft 102 for use. Embodiments of the invention may also comprise a switch mechanism to allow the user to switch off the light source when it not needed in order to conserver battery power. In an embodiment of the invention that utilizes a flashlight as the light source as is illustrated in FIG. 1, the flashlight may be selected such that is has an on/off switch located at an end of the flashlight. As is illustrated in FIG. 4, the hand grip portion 108 may comprise a recess 402. Such a recess may be provided with an opening such that when the flashlight is positioned within the handle assembly, the on/off switch 404 of the flashlight is accessible through the opening while the recess protects the on/off switch from damage that may result from the invention striking the ground or other surface.

Referring again to FIG. 1, in certain embodiments of the invention, a second reflector 110 may be positioned such that light transmitted from the light source 104 is reflected back into the shaft 102 as it reaches an end of the shaft opposite the light source. In some embodiments of the invention, such a reflector 110 may be omitted to allow the light to exit the end of the shaft to illuminate a work surface.

As is illustrated in FIG. 2, in an embodiment of the invention, an end of the shaft may be provided with one or more a mounting holes 204 which may be used to attach a tool 106 or hand grip 108 portion. In other embodiments of the invention, a threaded mounting method may be employed. Other embodiments may comprise any number of mounting methods which may include, but are not limited to, friction fit, glue surface, and crimped connections. Certain embodiments may also comprise an enlargement of the shaft to secure the tool portion in place. An example of such an embodiment is a pickaxe which generally is a friction fit onto a shaft where the shaft exhibits an increasing cross section as the end of the shaft is approached.

Figure 5:
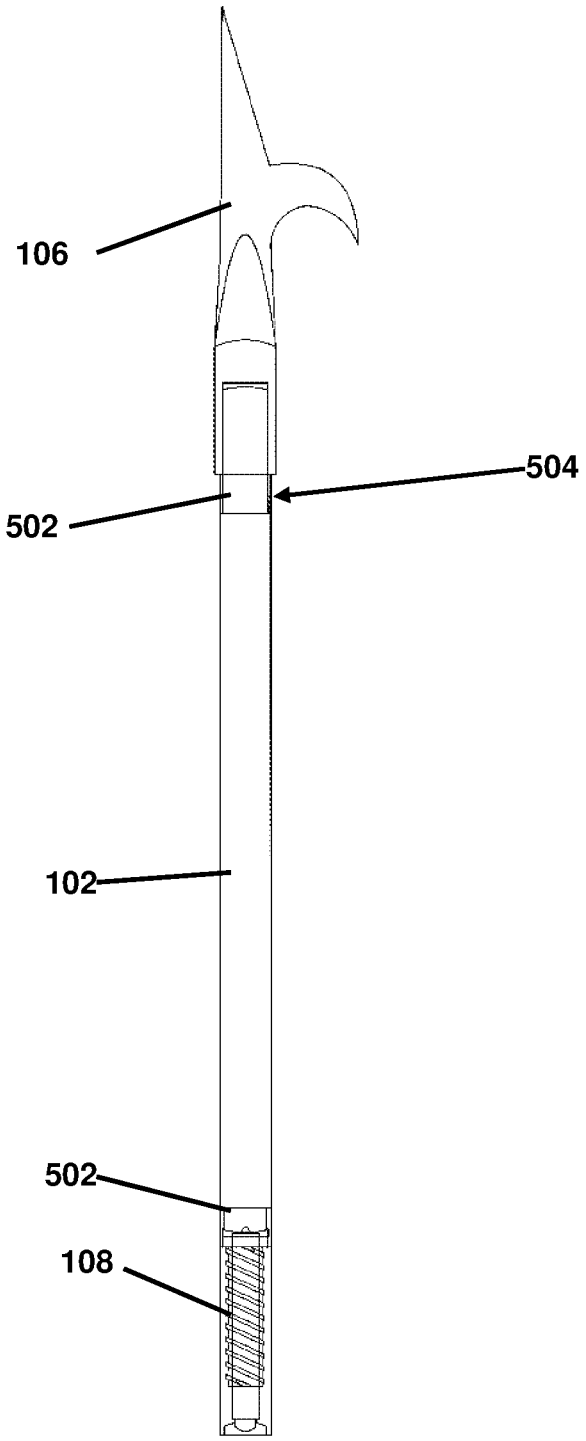
FIG. 5 is an illustration of an embodiment of the invention shown fully assembled.

As is illustrated in FIG. 5, the components of a complete tool are shown when completely assembled. As may be observed, the illustrated embodiment comprises a hand grip portion 108, a shaft 102 and a pike head 106. Depending upon the embodiment, the mounting point of the tool that tool may be removable to allow for the attachment of a different tool device. Such an embodiment may facilitate ease of manufacture or replacement and might not necessarily be user replaceable in the field. As is illustrated in FIG. 1, a plurality of fasteners 110 and 112 may be used to secure the tool and handle to the shaft 102. As is illustrated in FIG. 2, receiving holes 204 for these fasteners may be formed in a shaft 102 and as illustrated in FIG. 4, corresponding receiving holes 406 may be formed in the hand grip portion 108.

Figure 6A:
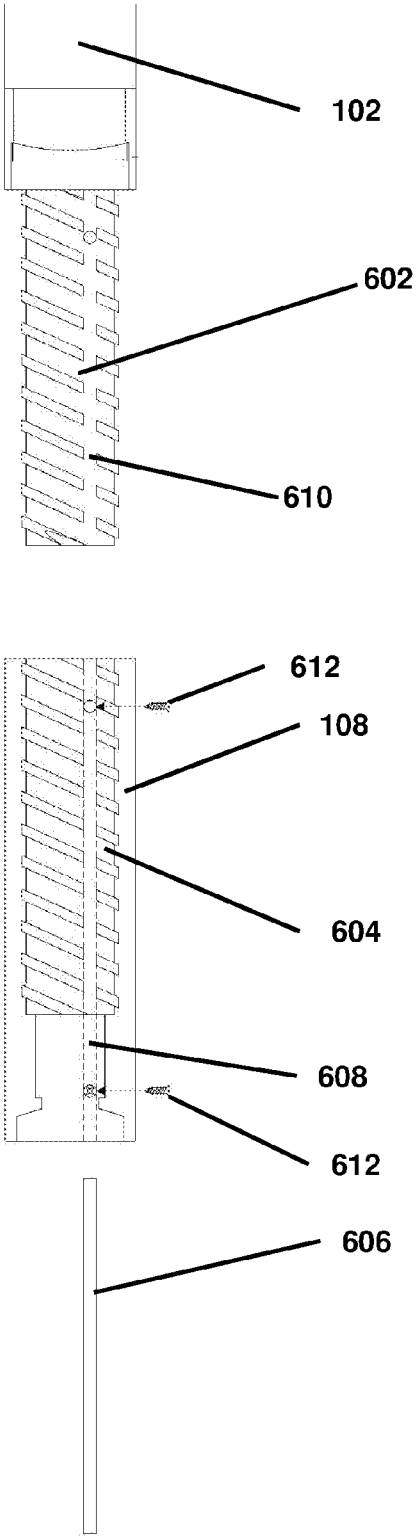
FIGS. 6A and 6B are illustrations of an embodiment of the invention in which the hand grip portion of the invention is attached with a threaded connection.
Figure 6B:
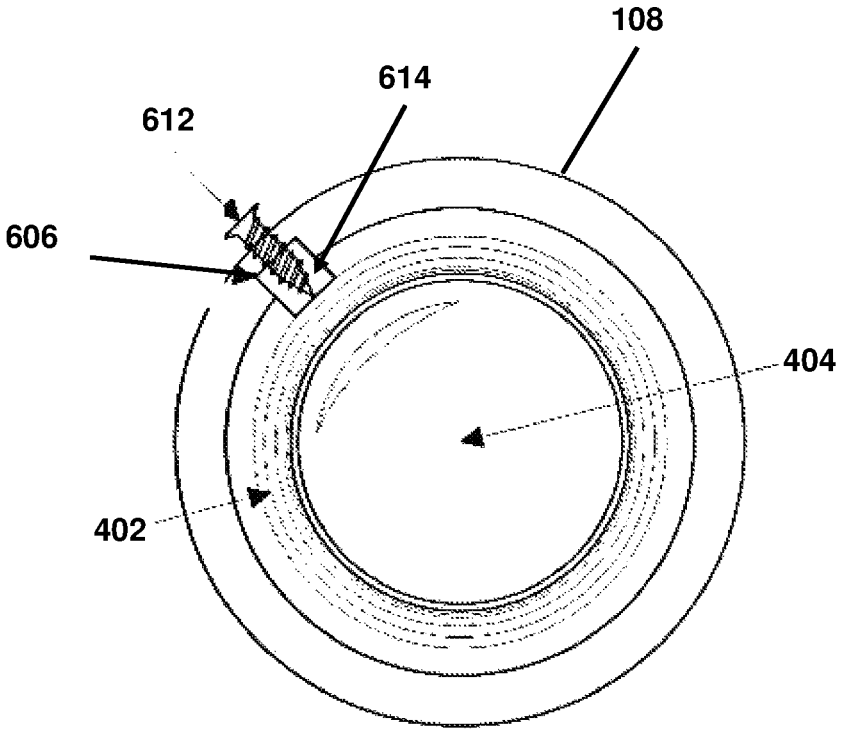

Additional methods may be used to secure the hand grip portion 108 or the tool 106 to the shaft in embodiments of the invention. As is illustrated in FIG. 6A, a threaded portion 602 may be formed in the shaft 102. The hand grip portion 108 may comprise an internally threaded portion 604 where the threads mate with those of the handle portion. In such an embodiment, a "key" 606 may be used to secure the handle to the threaded portion. This key may be inserted into a groove cut into the handle 608 and shaft 610 and secured with one or more screws 612, locking the handle and shaft together. The key 606 may be secured to the handle with a set screw 612 as illustrated in FIG. 6B at 614. Such an embodiment may allow for the hand grip portion 108 to be easily removed to access the flashlight for maintenance or battery replacement. Also visible in FIG. 6B is the recess 402 and the switch 404 of the light source 104.

As also illustrated in FIG. 5 is a glow ring 502. This portion may be positioned along the shaft 102. As is illustrated, the glow ring 502 is located between the hand grip portion 108 and the shaft 102. Other embodiments may position a glow ring 502 along the shaft 102 or at the tool to shaft junction 504. Certain embodiments may have a plurality of such glow rings. Glow rings 502 may be constructed of materials that reflect light or glow after exposure to light. As such, they may provide additional visibility for the user of the tool should the light source 104 not be illuminated.

As is illustrated in FIG. 1 at 116, gaskets may be used in an embodiment of the invention. These gaskets 116 may help limit the entry of dirt and debris into the shaft 202 of the invention. They may also provide a shock absorption function in order to protect the light source and shaft from vibration or shock damage.

Figure 7A:
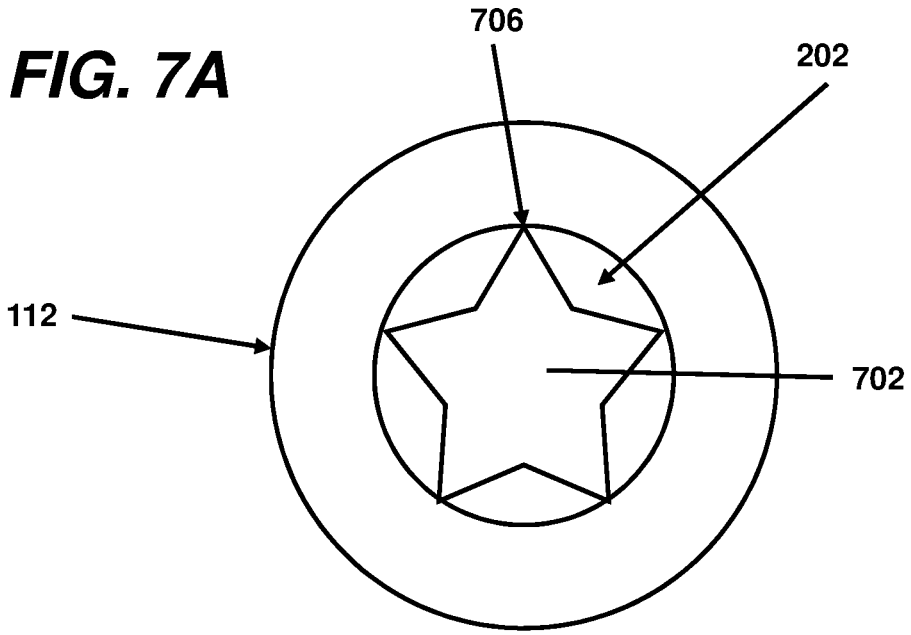
FIGS. 7A and 7B are illustrations of an embodiment of the invention in which an additional support structure has been added to the shaft portion of the invention.
Figure 7B:
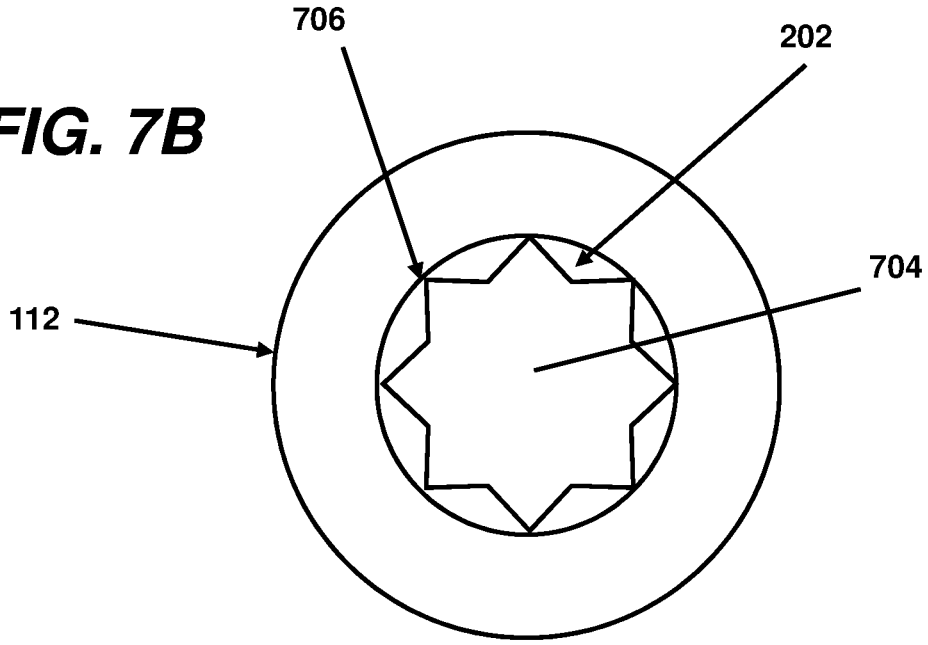

In certain embodiments of the invention, the length of the shaft 112 or the type of tool 106 affixed to the shaft may require that the shaft be enhanced to increase its strength or stiffness. As illustrated in FIG. 2, the shaft may comprise an opening 202 axially along at least a portion of the shaft 112. In order to strengthen or stiffen the shaft 112, an insert may be positioned within the opening 202. As is illustrated in FIGS. 7A and 7B, such an insert 702 and 704 may be shaped to form a cross section that makes contact with the inner wall 706 of the opening 202 of the shaft 112. In certain embodiments, the insert may be star shaped as illustrated at 702. This shape forms open areas between the points of the star as illustrated. These open areas may allow light to more easily illuminate the inner surfaces of the shaft 112. As is shown, other embodiments may comprise a greater number of contact points 704 while reducing the available open areas for light reach the shaft inner walls 706. The number of points shown in 702 and 704 are to illustrate the inventive concept. a greater or less number of points may be used. Additionally, the insert may be circular in shape to occupy the entire opening 202 in certain embodiments. The insert may be formed from the same material as the shaft 112 or alternatively may be formed of another light transmissive material. In certain embodiments, the insert may be formed from a more rigid material, including, but not limited to: wood or metal.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A tool comprising:

a straight, cylindrical, light transmissive shaft;

a fire ax head affixed to a first end of the shaft;

a hand grip portion affixed to a second end of the shaft;

a light source located along the shaft such that the light therefrom illuminates the interior of the shaft; and an on/off switch, in communication with the light source, arranged in the hand grip portion.

2. The tool of claim 1, wherein the shaft is hollow along at least a portion of its length.

3. The tool of claim 2, further comprising a strengthening insert located within at least a portion of the hollow portion of the shaft.

4. The tool of claim 2, wherein an interior surface of the shaft is textured so as to enhance the transmission of light from the light source radially along the length of the shaft.

5. The tool of claim 1, wherein the light source is positioned at least partially within the hand grip portion.

6. The tool of claim 1, wherein the on/off switch is arranged at an end of the hand grip portion.

7. The tool of claim 1, further comprising a reflector positioned proximate to the first end of the shaft.

8. The tool of claim 1, further comprising at least one gasket positioned at an end of the shaft.

9. The tool of claim 1, wherein the light source is a flashlight.

10. The tool of claim 1, further comprising at least one reflective collar positioned along the length of the shaft.

11. The tool of claim 1, wherein the shaft is comprised of a polycarbonate.

12. The tool of claim 1, wherein the shaft is comprised of a polymethylmethacrylate.

13. A tool, intended for use in fire-fighting, comprising:

a straight cylindrical light transmissive-shaft, hollow along at least a portion thereof;

a tool device affixed to a first end of the shaft, the tool device selected from the group consisting of: a fire ax head, a hammer head and a pike;

a hand grip portion affixed to a second end of the shaft;

a light source located at least partially within the hand grip portion, the light source arranged to direct light provided by the light source axially along the shaft;

an on/off switch, in communication with the light source and accessible from an end of the hand grip portion;

a reflector positioned proximally to the second end of the shaft and arranged such that reflects light from the light source back into the shaft;

at least one gasket positioned at an end of the shaft; and an interior surface of the hollow portion of the shaft textured so as to enhance the transmission of light from the light source radially along the shaft.

* * * * *